US010758973B2

(12) United States Patent
Du et al.

(10) Patent No.: US 10,758,973 B2
(45) Date of Patent: Sep. 1, 2020

(54) ALUMINUM WHEEL SQUEEZE CASTING PROCESS AND DEVICE

(71) Applicant: CITIC Dicastal CO., LTD, Qinhuangdao (CN)

(72) Inventors: Dexi Du, Qinhuangdao (CN); Changhai Li, Qinhuangdao (CN); Yongwang Zhao, Qinhuangdao (CN)

(73) Assignee: CITIC DICASTAL CO., LTD, Quinhuangdao, Hebei (CN)

( * ) Notice: Subject to any disclaimer, the term of this patent is extended or adjusted under 35 U.S.C. 154(b) by 162 days.

(21) Appl. No.: 16/058,281

(22) Filed: Aug. 8, 2018

(65) Prior Publication Data

US 2019/0283121 A1 Sep. 19, 2019

(30) Foreign Application Priority Data

Mar. 13, 2018 (CN) ..... 2018 1 02042331

(51) Int. Cl.

| | |
|---|---|
| ***B22D 18/02*** | (2006.01) |
| ***B22D 18/04*** | (2006.01) |
| ***B22D 27/11*** | (2006.01) |
| ***B22C 9/28*** | (2006.01) |
| ***B22D 25/02*** | (2006.01) |
| ***B22D 35/04*** | (2006.01) |

(52) U.S. Cl.

CPC ..... *B22D 18/02* (2013.01); *B22C 9/28* (2013.01); *B22D 18/04* (2013.01); *B22D 25/02* (2013.01); *B22D 27/11* (2013.01); *B22D 35/04* (2013.01)

(58) Field of Classification Search

CPC ..... B22C 9/28; B22D 18/02; B22D 18/04; B22D 27/11

See application file for complete search history.

(56) References Cited

FOREIGN PATENT DOCUMENTS

| | | | | |
|---|---|---|---|---|
| CN | 101445853 | A | 6/2009 | |
| CN | 107234224 | A | 10/2017 | |
| DE | 102006036369 | A1 | 2/2008 | |
| EP | 0273586 | A2 * | 7/1988 | ..... B22D 17/2236 |
| EP | 2319638 | A2 | 5/2011 | |
| GB | 1410770 | A | 10/1975 | |
| JP | 59202151 | A * | 11/1984 | ..... B22D 18/04 |
| JP | H03254353 | A | 11/1991 | |
| WO | WO-2017013590 | A1 * | 1/2017 | ..... B22C 23/02 |
| WO | 2017026959 | A1 | 2/2017 | |

* cited by examiner

*Primary Examiner* — Kevin E Yoon

(74) *Attorney, Agent, or Firm* — Calfee, Halter & Griswold LLP

(57) ABSTRACT

Disclosed is an aluminum alloy wheel squeeze casting process and an aluminum alloy wheel squeeze casting device. Molten aluminum is injected into a mold cavity from the bottom by adopting a U-shaped pipe, so that the filling is stable and the quality problem of the pore defect of a squeeze cast rim is solved; the squeeze deformation effect of the rim is strengthened using a mold locking ring; and through a secondary pressurization process for the center of the aluminum wheel, the internal dendritic spacing of the aluminum wheel casting is reduced, the yield strength and the elongation in the material mechanical properties of the casting are improved, and a necessary technical foundation is provided for overall weight reduction of the aluminum wheel.

9 Claims, 1 Drawing Sheet

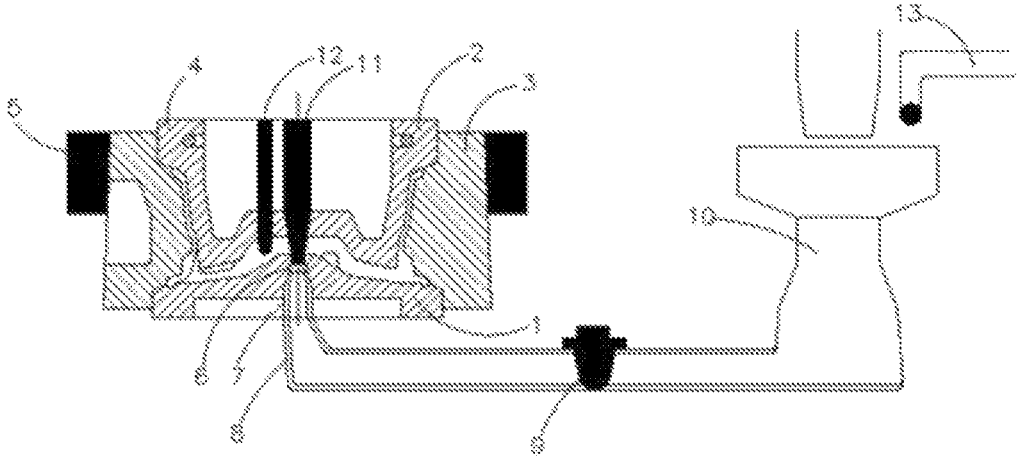
13
12
11
4
2
3
6
10
1
7
8
9

ALUMINUM WHEEL SQUEEZE CASTING PROCESS AND DEVICE

CROSS-REFERENCE TO RELATED APPLICATIONS

This application claims priority to Chinese Patent Application No. 201810204233.1 filed on Mar. 13, 2018, which is hereby incorporated by reference in its entirety.

TECHNICAL FIELD

The present application relates to the field of casting.

BACKGROUND ART

At present, in the conventional aluminum wheel squeeze casting, molten aluminum is directly guided into a center metering barrel and pushed into a mold cavity from bottom to top through a squeezing rod, then high pressure is applied to plasticize the solidified metal shell, the unsolidified metal bears isostatic pressure and is solidified under high pressure at the same time, and a finished casting is finally obtained. In the molten aluminum filling process, the molten aluminum is driven by the hydraulic pressure of the squeezing rod, so the filling speed is difficult to control and the phenomena of air entrapment and the like are easy to occur. In particular, the pore defect of the aluminum wheel rim occupies a large proportion, which seriously affects the yield.

SUMMARY OF THE INVENTION

The present application provides an aluminum wheel squeeze casting process and an aluminum wheel squeeze casting device, which focus on overcoming the pore defect of the rim of a squeeze cast aluminum wheel and improving the material mechanical properties of the spokes and the center of the aluminum wheel at the same time.

The technical solution adopted by the present application is: an aluminum wheel squeeze casting process uses a U-shaped pipe, molten aluminum is poured into the barrel of the U-shaped pipe on one side under the control of a metering pump and injected into a mold cavity through the U-shaped pipe from the bottom of a bottom mold, and molten aluminum filling is completed when the liquid level of the molten aluminum pouring end of the U-shaped pipe is flush with the highest end of an aluminum wheel casting in the mold cavity.

A pressure barrel is arranged above the barrel of the U-shaped pipe at the molten aluminum pouring end to apply pressure to the molten aluminum, so that the molten aluminum in the mold cavity is crystallized layer by layer under high pressure; and when the high pressure is applied to the molten aluminum pouring end of the U-shaped pipe, a mold locking ring arranged outside a side mold applies acting force to the aluminum wheel casting, so that the solidified casting shell is plasticized, and the unsolidified molten aluminum is solidified layer by layer from top to bottom under a water cooling process.

After crystallization and solidification of the rim, pressure rods arranged in the center of the aluminum wheel apply pressure to the aluminum wheel casting to squeeze the molten aluminum not solidified in the center of the aluminum wheel into the spokes and the wheel center. Secondary pressure feeding is started.

Finally, the pressure barrel, the mold locking ring, the side mold and pressure rods (the pressure rods corresponding to bolt holes and the center pressure rod) are detached in sequence, and the aluminum wheel casting is released along with a top mold until the entire casting process is completed.

An aluminum alloy wheel squeeze casting device includes a bottom mold, a side mold, a top mold, as well as a sprue bushing and a sprue cup under the bottom mold, where a U-shaped pipe is provided, a shutoff valve is arranged in the middle of the U-shaped pipe, and a metering pump is arranged on one side of the molten aluminum adding end of the U-shaped pipe. A pressure barrel is arranged at the molten aluminum adding end of the U-shaped pipe, and a center pressure rod and pressure rods corresponding to bolt holes play a role in secondary pressurization. A mold locking ring and a top mold water-cooled ring together play a role in squeeze deformation and layer-by-layer solidification of the rim.

Since the present application adopts a device of gravitational pouring and bottom filling of molten aluminum under the principle of a U-shaped pipe, the molten aluminum filling process has the characteristic of smooth filling of low-pressure casting, and solves the quality problem of the pore defect of the rim of the squeeze cast aluminum wheel; the squeeze deformation effect of the rim is strengthened using the mold locking ring, so that the mechanical elongation of the rim material is improved by 50%, and the purpose of reducing the weight of a product may be achieved by structural optimization; and through the secondary pressurization process design for the center of the aluminum wheel, the internal dendritic spacing of the aluminum wheel casting is reduced, particularly, the material mechanical properties of the spokes and the wheel center are improved, the yield strength is improved by 20%, the elongation is improved by 30%, and a necessary technical foundation is provided for overall weight reduction of the aluminum wheel.

BRIEF DESCRIPTION OF DRAWINGS

The present application will be further illustrated below in conjunction with the drawing and embodiments.

FIG. 1 is a schematic diagram of an aluminum wheel squeeze casting device of the present application.

1—bottom mold, 2—top mold, 3—side mold, 4—top mold water-cooled ring, 5—mold locking ring, 6—sprue bushing, 7—sprue cup, 8—U-shaped pipe, 9—shutoff valve, 10—pressure barrel, 11—center pressure rod, 12—pressure rods corresponding to bolt holes, 13—metering pump.

DETAILED DESCRIPTION OF THE INVENTION

The details and working conditions of the specific device proposed by the present application will be described below in combination with the accompanying drawings.

An aluminum wheel squeeze casting process uses a U-shaped pipe 8, molten aluminum is poured into the barrel of the U-shaped pipe 8 on one side under the control of a metering pump 13 and injected into a mold cavity through the U-shaped pipe 8 from the bottom of a bottom mold 1, and molten aluminum filling is completed when the liquid level of the molten aluminum pouring end of the U-shaped pipe 8 is flush with the highest end of an aluminum wheel casting in the mold cavity.

A pressure barrel 10 is arranged above the barrel of the U-shaped pipe 8 at the molten aluminum pouring end to apply pressure to the molten aluminum, so that the molten aluminum in the mold cavity is crystallized layer by layer under high pressure; and when the high pressure is applied to the molten aluminum pouring end of the U-shaped pipe 8, a mold locking ring 5 arranged outside a side mold 3 applies an acting force to the aluminum wheel casting, so that the solidified casting shell is plasticized, and the unsolidified molten aluminum is solidified layer by layer from top to bottom under a water cooling process.

After crystallization and solidification of the rim, a center pressure rod 11 arranged in the center of the aluminum wheel and pressure rods 12 corresponding to bolt holes apply pressure to the aluminum wheel casting to squeeze the molten aluminum not solidified in the center of the aluminum wheel into the spokes and the wheel center. Secondary pressure feeding is started to improve the crystallization and solidification speed of the thick position of the spoke and wheel center casting and reduce the internal dendritic spacing of the casting, until the aluminum wheel squeeze casting is completely solidified.

Finally, the pressure barrel 10, the mold locking ring 5, the side mold 3 and pressure rods (the pressure rods 12 corresponding to bolt holes and the center pressure rod 11) are detached in sequence, and the aluminum wheel casting is released along with a top mold 2 until the entire casting process is completed.

An aluminum alloy wheel squeeze casting device includes a bottom mold 1, a top mold 2, a side mold 3, as well as a sprue bushing 6 and a sprue cup 7 under the bottom mold 1, wherein a U-shaped pipe 8 is provided, a shutoff valve 9 is arranged in the middle of the U-shaped pipe 8, and a metering pump 13 is arranged on one side of the molten aluminum adding end of the U-shaped pipe 8. A pressure barrel 10 is arranged at the molten aluminum adding end of the U-shaped pipe 8, and a center pressure rod 11 and pressure rods 12 corresponding to bolt holes play a role in secondary pressurization. A mold locking ring 5 and a top mold water-cooled ring 4 together play a role in squeeze deformation and layer-by-layer solidification of the rim.

The inner wall of the U-shaped pipe 8 is made of SiC and the outer wall is wrapped by a copper heating jacket, so that the U-shaped pipe 8 can withstand the squeezing pressure in the casting process, can ensure that molten aluminum passes smoothly and has the function of heat insulation.

The upper edge of the U-shaped pipe 8 at the molten aluminum adding end is higher than the uppermost end of an aluminum wheel casting to ensure a sufficient volume for accommodating molten aluminum before the molten aluminum is added, and the pitch diameter of the upper orifice of the U-shaped pipe 8 at the molten aluminum adding end is more than or equal to 100 mm.

The shutoff valve 9 arranged in the middle of the U-shaped pipe 8 is controlled by signal connection with a PLC of casting equipment, and shuts off the molten aluminum before the molten aluminum is completely squeezed into the mold cavity through the U-shaped pipe 8 and casting pressure relief is completed, to ensure that the liquid level of the molten aluminum at the filling end of the U-shaped pipe 8 is maintained in the sprue cup 7 without overflow when the mold is opened to take the casting out.

The cross-section area of the U-shaped pipe 8 at the molten aluminum filling section decreases progressively, and the U-shaped pipe 8 is connected with the sprue cup 7 and the sprue bushing 6 under the mold.

The mold locking ring 5 is integrally cast from 35CrMo, and its inner wall inclines 15° and is fitted with the annular surface of the outer wall of the side mold 2 in contact.

The mold locking ring 5 is controlled and pressurized by an independent cylinder independent from a pressure device of the casting equipment to ensure that the mold locking ring 5 arrives at the designated position under enough driving force, lock the side mold 5 under the maximum squeezing force of 1000 MPa and apply pressure for starting squeezing formation in the solidification process of the aluminum wheel rim.

The double-inlet and double-outlet top mold water-cooled ring 4 is arranged above the top mold 2, its cavity section diameter is 8-10 mm, and the annular water-cooled channel is 20-40 mm away from the top end of the aluminum wheel rim casting. The top mold water-cooled ring 4 is opened when the mold cavity is full of the molten aluminum, and closed after the overall solidification process of the rim is completed within about 30-60 seconds.

The pressure rods in the center of the aluminum wheel include a center pressure rod 11 and pressure rods 12 corresponding to bolt holes. The diameter of the center pressure rod 11 is at least 30 mm, and the maximum diameter does not exceed the product machining line of the center hole of the aluminum wheel. The diameters of the pressure rods 12 corresponding to bolt holes are at least 10 mm, and the maximum diameters do not exceed the diameters of the bolt holes.

The pressure strokes of the pressure rods in the center of the aluminum wheel need to be calculated to ensure that the molten aluminum may be squeezed into the casting and achieves a feeding effect, and their volume at least meets 5% of the volume of the wheel center.

The squeeze casting bottom mold 1 is made of H13 with surface hot dip coating and micro arc oxidation to generate the dense ceramic, so that the surface of the bottom mold 1 does not need the protection of a coating and the surface quality of the casting can be maintained.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An aluminum wheel squeeze casting process, wherein that molten aluminum is poured into a barrel of a U-shaped pipe on one side under the control of a metering pump and injected into a mold cavity through the U-shaped pipe from a bottom of a mold, and molten aluminum filling is completed when a liquid level of the molten aluminum pouring end of the U-shaped pipe is flush with the highest end of an aluminum wheel casting in the mold cavity;

when a pressure barrel above the barrel of the U-shaped pipe applies pressure to the molten aluminum, a mold locking ring arranged outside a side mold of the mold applies an acting force to the aluminum wheel casting, so that a solidified casting shell is plasticized, and an unsolidified molten aluminum is solidified layer by layer from top to bottom under a water cooling process;

after crystallization and solidification of a rim, a plurality of pressure rods arranged in a center of the aluminum wheel apply pressure to the aluminum wheel casting to squeeze the molten aluminum not solidified in the center of the aluminum wheel into a spokes and the wheel center, thus starting secondary pressure feeding; and finally, the pressure barrel, the mold locking ring, the side mold, the pressure rods are detached in sequence, and the aluminum wheel casting is released along with a top mold until the entire casting process is completed.

2. An aluminum alloy wheel squeeze casting device, comprising a bottom mold, a side mold, a top mold, as well as a sprue bushing and a sprue cup under the bottom mold, wherein that a U-shaped pipe is provided, a shutoff valve is arranged in the middle of the U-shaped pipe, and a metering pump is arranged on one side of a molten aluminum adding end of the U-shaped pipe; a pressure barrel is arranged at the molten aluminum adding end of the U-shaped pipe, and a center pressure rod and pressure rods corresponding to bolt holes perform secondary pressure feeding on a casting.

3. The aluminum alloy wheel squeeze casting device according to claim 2, wherein that an inner wall of the U-shaped pipe is made of SiC and an outer wall is wrapped by a copper heating jacket.

4. The aluminum alloy wheel squeeze casting device according to claim 2, wherein that an upper edge of the U-shaped pipe at the molten aluminum adding end is higher than the uppermost end of the aluminum wheel casting, and the pitch diameter of an upper orifice of the U-shaped pipe at the molten aluminum adding end is more than or equal to 100 mm.

5. The aluminum alloy wheel squeeze casting device according to claim 2, wherein that the mold locking ring is integrally cast from 35CrMo, and its inner wall inclines 15° and is fitted with an annular surface of an outer wall of the side mold in contact.

6. The aluminum alloy wheel squeeze casting device according to claim 2, wherein that the mold locking ring is controlled and pressurized by an independent cylinder independent from a pressure device of the casting equipment.

7. The aluminum alloy wheel squeeze casting device according to claim 2, wherein that a double-inlet and double-outlet top mold water-cooled ring is arranged above the top mold, its cavity section diameter is 8-10 mm, and the annular water-cooled channel of the top mold water-cooled ring is 20-40 mm away from a top end of the aluminum wheel rim casting.

8. The aluminum alloy wheel squeeze casting device according to claim 2, wherein a diameter of the center pressure rod is at least 30 mm, and the maximum diameter does not exceed a product machining line of the center hole of the aluminum wheel; the diameters of the pressure rods corresponding to bolt holes are at least 10 mm, and the maximum diameters do not exceed the diameters of the bolt holes.

9. The aluminum alloy wheel squeeze casting device according to claim 2, wherein the bottom mold is made of H13 with surface hot dip coating and micro arc oxidation.

* * * * *